US005678377A

United States Patent [19]

Leopold

[11] Patent Number: 5,678,377

[45] Date of Patent: Oct. 21, 1997

[54] INSULATING GLASS UNIT

[75] Inventor: Edmund A. Leopold, Hudson, Ohio

[73] Assignee: Glass Equipment Development, Inc., Twinsburg, Ohio

[21] Appl. No.: 196,699

[22] Filed: Feb. 15, 1994

Related U.S. Application Data

[62] Division of Ser. No. 827,281, Jan. 29, 1992, Pat. No. 5,313,761.

[51] Int. Cl.[6] ..... E04C 2/38

[52] U.S. Cl. ..... 52/656.9; 52/314; 52/656.8; 52/704; 52/712

[58] Field of Search ..... 52/455, 456, 314, 52/656.8, 656.9, 790, 712, 704

[56] References Cited

U.S. PATENT DOCUMENTS

| | | |
|---|---|---|
| 1,877,336 | 9/1932 | Lovell et al. . |
| 1,975,895 | 10/1934 | Geyer . |
| 2,173,664 | 9/1939 | Shutts . |
| 2,235,680 | 3/1941 | Haven et al. . |
| 2,348,307 | 5/1944 | Richardson . |
| 2,587,063 | 2/1952 | Petsch . |
| 2,625,717 | 1/1953 | Wampler et al. . |
| 2,750,637 | 6/1956 | Browne . |
| 2,768,475 | 10/1956 | Seelen et al. . |
| 2,869,694 | 1/1959 | Brekheimer . |
| 2,996,161 | 8/1961 | Edling . |
| 3,021,243 | 2/1962 | Bethge . |
| 3,026,582 | 3/1962 | Bayer . |

(List continued on next page.)

FOREIGN PATENT DOCUMENTS

| | | |
|---|---|---|
| 132516 | 4/1984 | European Pat. Off. . |
| 305352 | 8/1987 | European Pat. Off. . |
| 475213 | 8/1991 | European Pat. Off. . |
| 2428728 | 6/1979 | France . |
| 2449222 | 2/1980 | France . |
| 2637034 | 2/1978 | Germany . |
| 2506298 | 8/1988 | Germany . |
| 8805653 | 8/1988 | Germany . |
| 349875 | 6/1931 | United Kingdom . |
| 1509178 | 5/1975 | United Kingdom . |
| 2072249 | 9/1981 | United Kingdom . |

OTHER PUBLICATIONS

A page from a High Quality Tools catalog illustrating a Quill–Feed Speed Handle, HQT Part No. 1021.

Technical report dated May 1988 by M. Glover & G. Reichert of Edgetech I.G. Ltd. entitled "Super Spacer™".

Advertisement dated Mar. 15, 1990 in Glass Digest for "Versa–Therm" framing system by Tubelite Indal.

Article dated 1989 in ASHREA Transactions (V. 95 Pt. 2) by J. L. Wright et al. entitled "Thermal Resistance Measurement of Glazing System . . . ".

Copy of European Search Report dated Jun. 4, 1993 for EP Appln. No: 93 100393.3, which corresponds to prior application U.S. Ser. No.: 07/827,281 filed Jan. 29, 1992.

Copy of EP Search Report dated Aug. 3, 1993 for EP Appln. No. EP 93 100393.3 which corresponds to prior application S.N. No: 07/827,281 filed Jan. 29, 1992.

*Primary Examiner*—Christopher T. Kent

*Attorney, Agent, or Firm*—Watts, Hoffmann, Fisher & Heinke Co., L.P.A.

[57] ABSTRACT

Spacer frame assembly for an insulating glass unit comprising a plurality of spacer frame elements connected to form a generally planar polygonal frame. Each frame element defines an impervious outer peripheral wall and first and second lateral walls, integral with the outer wall, extending inwardly from opposite outer wall sides parallel to the frame plane. The outer wall and lateral walls extend substantially continuously about the frame polygon and are joined adjacent their ends by connecting structure. The connecting structure comprises a connecting tongue continuous with and projecting from an end of one frame element. The other frame element end has a tongue receiving structure and the element ends are telescopically joined. Muntin bars are secured to the frame elements by latching structures which assure quick muntin bar assembly.

10 Claims, 4 Drawing Sheets

U.S. PATENT DOCUMENTS

| | | | |
|---|---|---|---|
| 3,030,673 | 4/1962 | London . | |
| 3,045,297 | 7/1962 | Ljungdahl . | |
| 3,054,153 | 9/1962 | Partsch . | |
| 3,105,274 | 10/1963 | Armstrong . | |
| 3,212,179 | 10/1965 | Koblensky . | |
| 3,267,569 | 8/1966 | Eichhorn et al. . | |
| 3,280,523 | 10/1966 | Stroud et al. . | |
| 3,283,890 | 11/1966 | Morris et al. . | |
| 3,657,900 | 4/1972 | Bowser et al. . | |
| 3,686,814 | 8/1972 | Anderson | 52/456 |
| 3,919,023 | 11/1975 | Bowser et al. . | |
| 3,974,823 | 8/1976 | Patel . | |
| 4,015,394 | 4/1977 | Kessler . | |
| 4,057,945 | 11/1977 | Kessler . | |
| 4,063,002 | 12/1977 | Wilson, Jr. . | |
| 4,084,720 | 4/1978 | Thurston . | |
| 4,109,431 | 8/1978 | Mazzoni et al. . | |
| 4,222,213 | 9/1980 | Kessler . | |
| 4,431,691 | 2/1984 | Greenlee . | |
| 4,513,546 | 4/1985 | Gow . | |
| 4,520,611 | 6/1985 | Shingu et al. . | |
| 4,530,195 | 7/1985 | Leopold . | |
| 4,546,723 | 10/1985 | Leopold et al. . | |
| 4,597,232 | 7/1986 | Lingemann . | |
| 4,622,249 | 11/1986 | Bowser . | |
| 4,628,582 | 12/1986 | Leopold . | |
| 4,780,164 | 10/1988 | Rueckheim et al. . | |
| 4,783,938 | 11/1988 | Palmer | 52/456 |
| 4,807,419 | 2/1989 | Hodak et al. . | |
| 4,808,452 | 2/1989 | McShane . | |
| 4,831,799 | 5/1989 | Glover et al. . | |
| 4,856,243 | 8/1989 | Ault et al. . | |
| 4,873,803 | 10/1989 | Rundo . | |
| 4,970,840 | 11/1990 | Ouellette et al. | 52/456 |
| 4,989,384 | 2/1991 | Kinghorn et al. | 52/456 |
| 5,099,626 | 3/1992 | Seeger | 52/314 |
| 5,177,916 | 1/1993 | Misera et al. . | |

INSULATING GLASS UNIT

This is a divisional of application Ser. No. 07/827,281 filed on Jan. 29, 1992, now U.S. Pat. No 5,313,761.

FIELD OF THE INVENTION

The present invention relates to an insulating glass unit and particularly to an improved insulating glass unit spacer assembly.

BACKGROUND OF THE INVENTION

Insulating glass units (IGUs) are used in windows to reduce heat loss from building interiors during cold weather. IGUs are typically formed by a spacer assembly sandwiched between glass lights. A spacer assembly usually comprises a frame structure extending peripherally about the unit, a sealant material adhered both to the glass lights and the frame structure, and a desiccant for absorbing atmospheric moisture within the unit. The margins of the glass lights are flush with or extend slightly outwardly from the spacer assembly. The sealant extends continuously about the frame structure periphery and its opposite sides so that the space within the IGU is hermetic.

There have been numerous proposals for constructing IGUs. One type of IGU was constructed from an elongated body of hot melt material having a corrugated sheet metal strip embedded in it. Desiccant was also embedded in the hot melt. The resulting composite frame forming strip was bent into a rectangular shape and sandwiched between conforming glass lights.

Perhaps the most successful IGU construction has employed tubular, roll formed aluminum or steel frame elements connected at their ends to form a square or rectangular spacer frame. Particulate desiccant deposited inside the tubular frame elements communicated with air trapped in the IGU interior to remove the entrapped airborne water vapor and thus preclude its condensation within the unit. The frame sides and corners were covered with sealant formed by a hot melt material for securing the frame to the glass lights. The sealant provided a barrier between atmospheric air and the IGU interior which blocked entry of atmospheric water vapor. Thus after the water vapor entrapped in the IGU was removed internal condensation only occurred when the unit failed.

Among other reasons, units failed because atmospheric water vapor infiltrated the sealant barrier. Infiltration tended to occur at the frame corners because the opposite frame sides were at least partly discontinuous there. For example, in some frames the corners were formed by cutting "V" shaped notches at corner locations in a single long tube. The notches enabled bending the tube to form mitred corner joints. After bending to form the corners potential infiltration paths extended along the corner parting lines substantially across the opposite frame faces at each corner.

In other frame constructions "corner keys" were inserted between adjacent frame element ends to form the corners. These corner keys produced potential infiltration paths at their junctures with the frame elements. In some constructions the corner keys were foldable so that the sealant could be extruded onto the frame sides as the frame moved linearly past a sealant extrusion station. The frame was then folded to a rectangular configuration with the sealant in place on the opposite sides. In some of these proposals the sealant was extruded into the space between the frame element end edges. When the frame was folded into its final form the sealant extruded between the element ends was not present at the frame corners. This reduction in the amount of sealant at the corners tended to cause vapor leakage paths into the IGU, particularly after the unit was in service over a period of time.

In all these proposals the frame elements were cut to length and, in the case of frames connected together by corner keys, the keys were installed before applying the sealant. These were manual operations. Accordingly, fabricating IGUs from these frames entailed generating scrap and inefficient manual operations.

Still other proposals for spacer frame constructions involved roll forming the spacer elements, sawing a V-shaped notch at each corner location so that the spacer members remained attached and foldable at the corner, filling frame members with desiccant and plugging them and then cutting off the frame member. The frame member was then coated with hot melt and folded onto its final configuration. The sawing, filling and plugging operations had to be performed by hand which slowed production of these frames.

It is known that heat losses from IGUs occur via conductive heat transfer at the edges of the units where the glass lights are attached. The extent of such losses depends upon the conductivity and geometry of the heat path between the lights. Roll formed spacer frames were tubular so that two frame element walls extended between the glass lights. The heat path extended from the warmer light through the sealant coating the adjacent frame side, both frame element walls extending between the lights, and through the sealant on the opposite frame side to the cooler light.

The sealant materials presented a heat flow path having a large cross sectional area and the hot melt materials themselves were not highly effective insulators. Accordingly the heat path through the sealants was capable of substantial heat conduction. The limiting factor in the heat path was the spacer frame walls. They had relatively small cross sectional areas which tended to restrict heat flow. However, frame element conductivity was great particularly because aluminum, the typical frame material, is highly conductive. Thus the heat losses due to conduction along the edges of the IGUs were significant.

Moreover, because the heat losses occurred along concentric paths spaced inwardly from the glass light peripheries, the warmer glass lights tended to be "cold" well inwardly from their peripheries. Beside the disadvantage of heat loss, cold edge IGUs caused other unacceptable problems. For example, condensation tended to occur on the margins of the warmer glass light. This was unsightly and the accumulated moisture was particularly destructive to wooden IGU support structures, such as wooden window frames. Furthermore, condensed moisture could freeze along the margins of the indoor light during cold weather. This threatened damage to the IGU support structure.

The present invention provides a new and improved IGU and method of making it wherein completed IGUs exhibit significantly reduced "cold edge" effects and spacer frame assembly construction is conducted at high production rates, creating little scrap and involving minimal handling. The new IGU is structurally strong and durable, functionally superior to the prior units and can be produced in a highly efficient manner.

DISCLOSURE OF THE INVENTION

The present invention provides a new and improved spacer frame assembly for an insulating glass unit comprising a plurality of spacer frame elements connected to form a generally planar polygonal frame. Each frame element defines an impervious outer peripheral wall and first and second lateral walls, integral with the outer wall, extending inwardly from opposite outer wall sides parallel to the frame plane. The outer wall and lateral walls extend substantially continuously about the frame polygon and are joined adjacent their ends by connecting structure. The connecting structure comprises a connecting tongue continuous with and projecting from an end of one frame element. The other frame element end has a tongue receiving structure and the element ends are telescopically joined.

Additional features of the invention will become apparent from the following detailed description of a preferred embodiment made with reference to the accompanying drawings.

DESCRIPTION OF A PREFERRED EMBODIMENT

Figure 1:
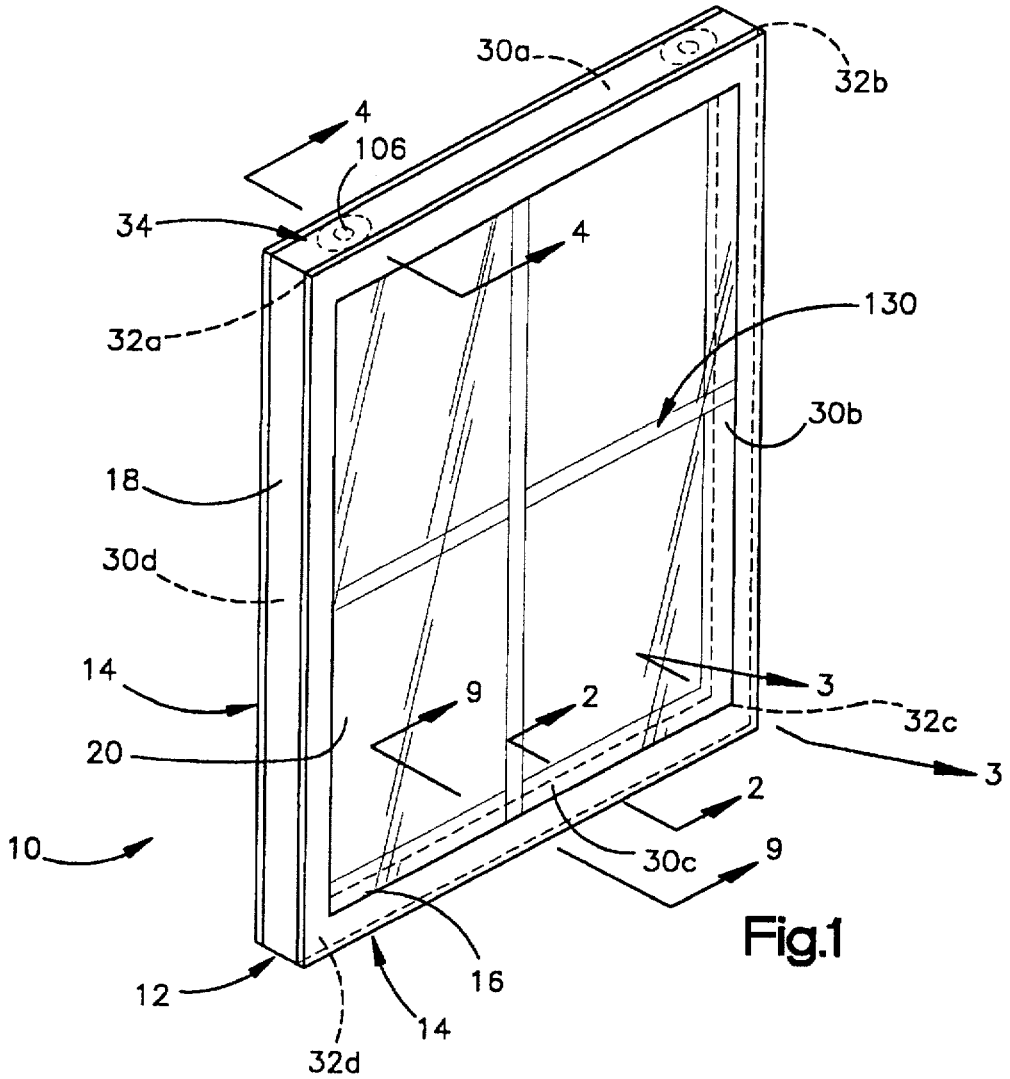
FIG. 1 is a perspective view of an insulating glass unit constructed according to the invention.
Figure 2:
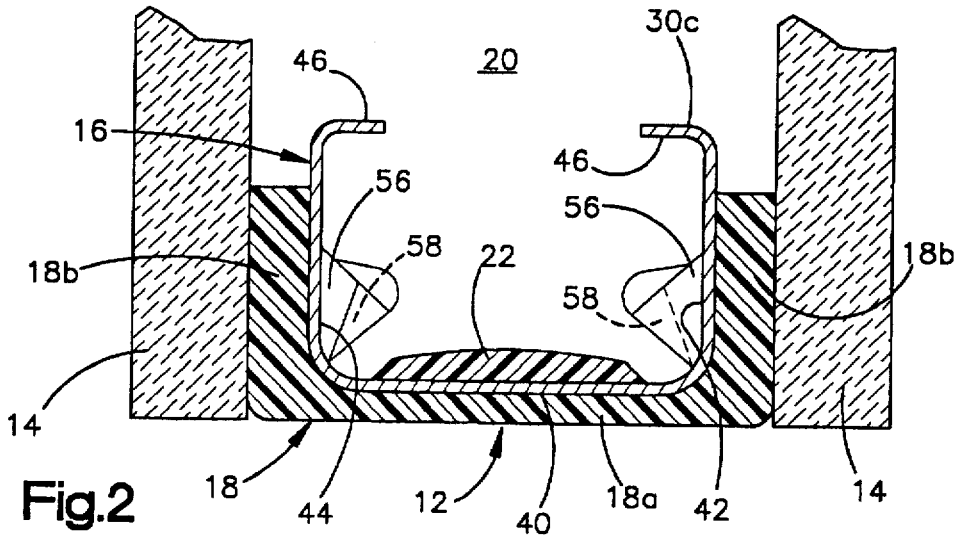
FIG. 2 is an enlarged fragmentary cross sectional view seen approximately from the plane indicated by the line 2—2 of FIG. 1.
Figure 3:
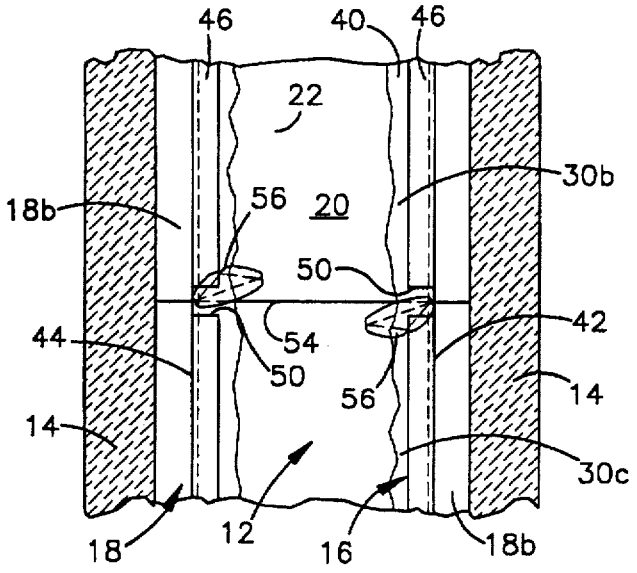
FIG. 3 is an enlarged fragmentary cross sectional view seen approximately from the plane indicated by the line 3—3 of FIG. 1.
Figure 4:
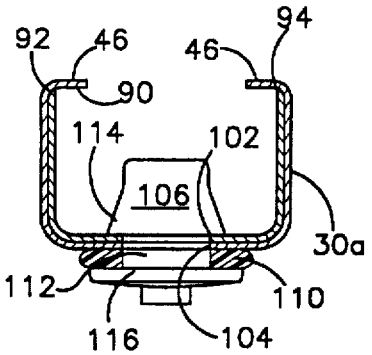
FIG. 4 is an enlarged fragmentary cross sectional view seen approximately from the plane indicated by the line 4—4 of FIG. 1.

An insulating glass unit 10 constructed according to the present invention is illustrated by FIGS. 1–3 as comprising a spacer assembly 12 sandwiched between glass sheets, or lights, 14. The assembly 12 comprises a frame structure 16, sealant material 18 for hermetically joining the frame to the lights to form a closed space 20 within the unit 10 and a body 22 of desiccant in the space 20. The unit 10 is illustrated as in condition for final assembly into a window or door frame, not illustrated, for ultimate installation in a building.

The glass lights 14 are constructed from any suitable or conventional glass. The lights are rectangular, aligned with each other and sized so that their peripheries are disposed just outwardly of the frame outer periphery. While it is not essential that the lights be transparent, the disclosure and description which follows assumes the unit 10 is used in a window frame installed in a building.

The assembly 12 functions to maintain the lights 14 spaced apart from each other to produce the hermetic insulating "dead air space" 20 between them. The frame 16 and the sealant body 18 coact to provide a structure which maintains the lights 14 properly assembled with the space 20 sealed from atmospheric moisture over long time periods during which the unit 10 is subjected to frequent significant thermal stresses. The desiccant body 22 serves to remove water vapor from air, or other gas, entrapped in the space 20 during construction of the unit 10.

The sealant body 18 both structurally adheres the lights 14 to the spacer assembly 12 and hermetically closes the space 20 against infiltration of airborne water vapor from the atmosphere surrounding the unit 10. The illustrated body 18 is formed from a "hot melt" material which is attached to the frame sides and outer periphery to form a U-shaped cross section. In constructing the preferred unit 10 the sealant body 18 is extruded onto the frame 16. This is accomplished for example by passing the frame through a sealant application station of an extruder such as that disclosed by U.S. Pat. No. 4,628,582. Although a "hot melt" sealant is disclosed, other suitable or conventional substances (singly or in combination) for sealing and structurally securing the unit components together may be employed.

After the sealant body 18 is attached to the frame 16 it is heated and the lights 14 and spacer assembly 12 are passed through the nips of a series of press rolls (not illustrated). The rolls compress the body 18 between the frame 16 and the lights 14 to adhere them firmly together. The hot melt forming the body 18 is a composition which assures strong adhesion to the frame and the lights by joints which are both structurally strong and impervious to atmospheric moisture infiltration of the space 20. The "bight" **18*a* of the U-shaped sealant body (FIG. 2) is continuous with the legs 18*b*** and functions to lengthen the vapor barrier between the glass and the body while encapsulating the frame exterior.

Figure 5:
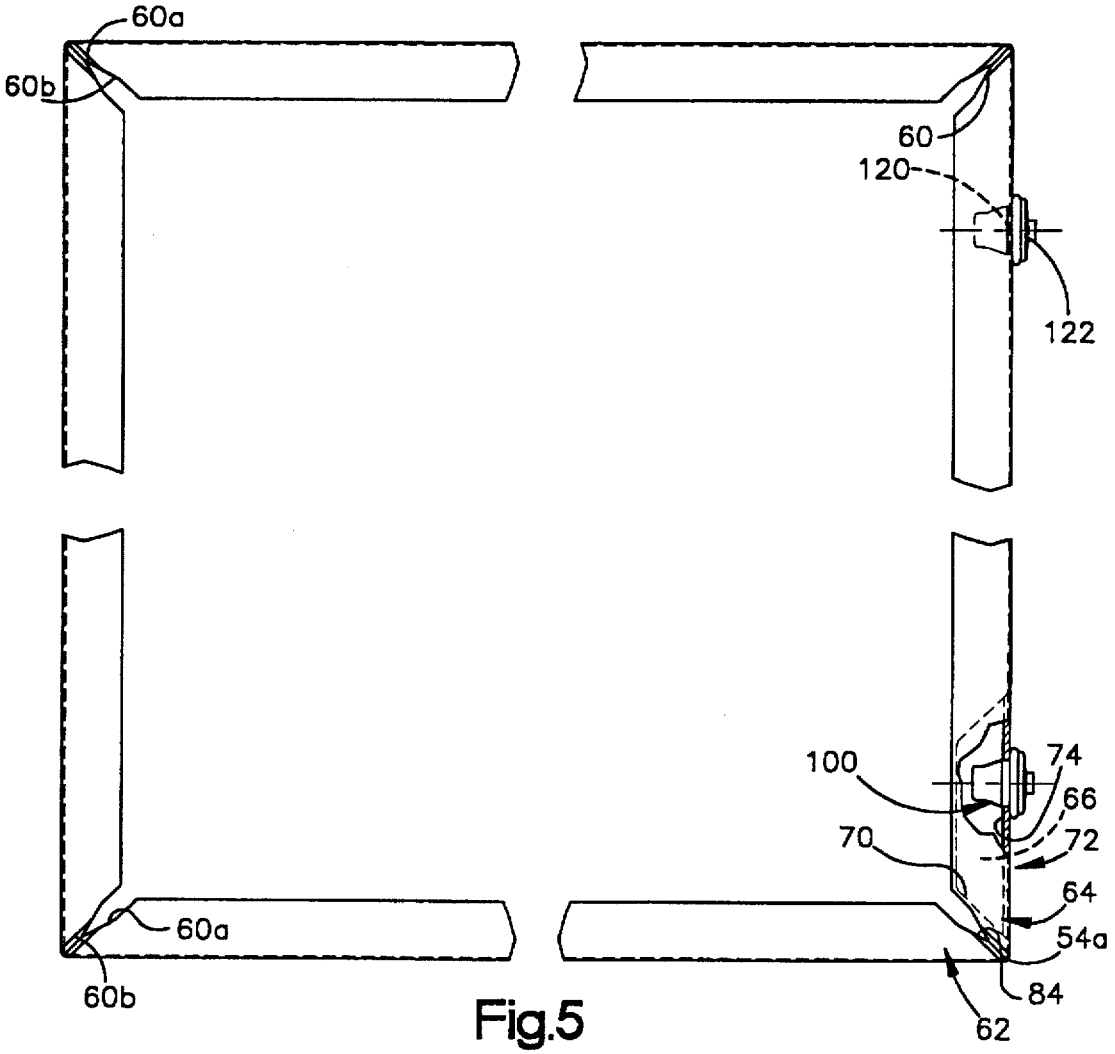
FIG. 5 is a fragmentary plan view of a spacer frame forming part of the unit of FIG. 1 which is illustrated in a partially constructed condition.
Figure 7:
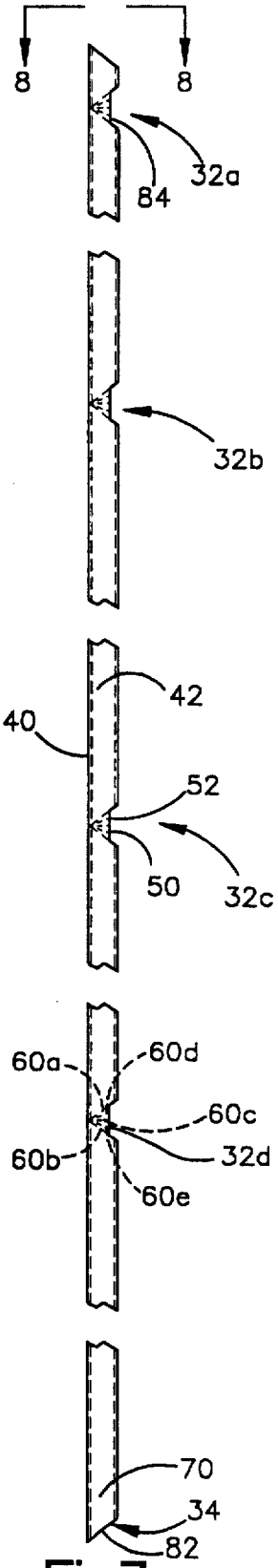
FIG. 7 is a fragmentary elevational view of the element of FIG. 6.
Figure 6:
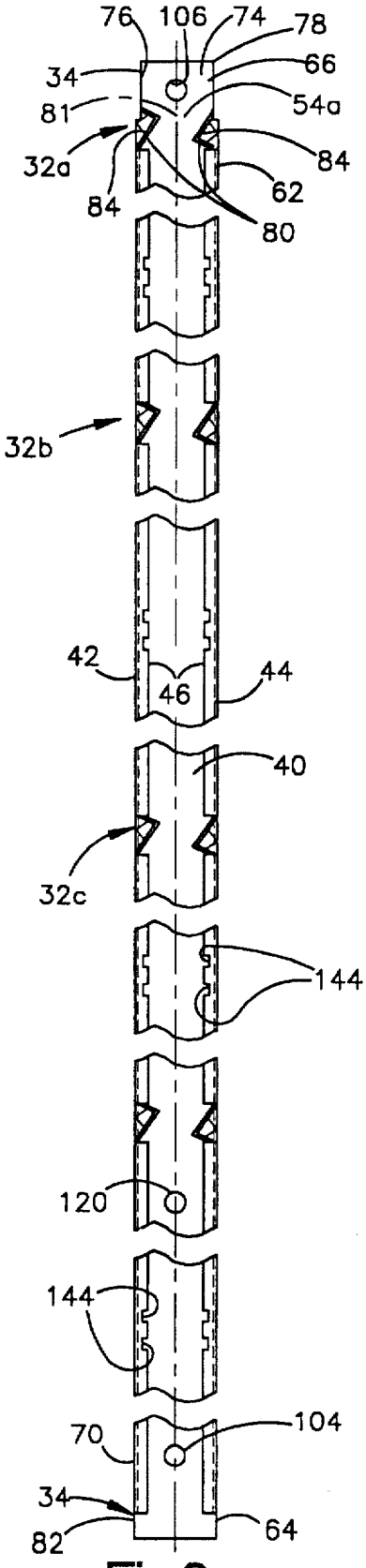
FIG. 6 is a fragmentary plan view of a spacer frame element before the element has had sealant applied and in an unfolded condition.
Figure 8:
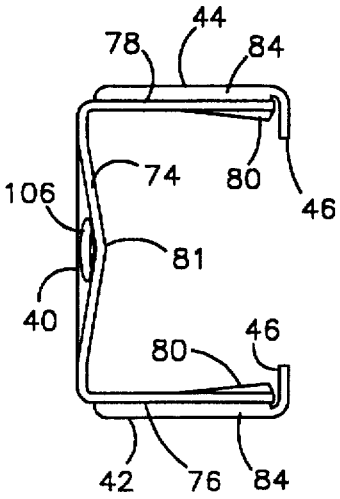
FIG. 8 is an enlarged elevational view seen approximately from the plane indicated by the line 8—8 of FIG. 7.
Figure 9:
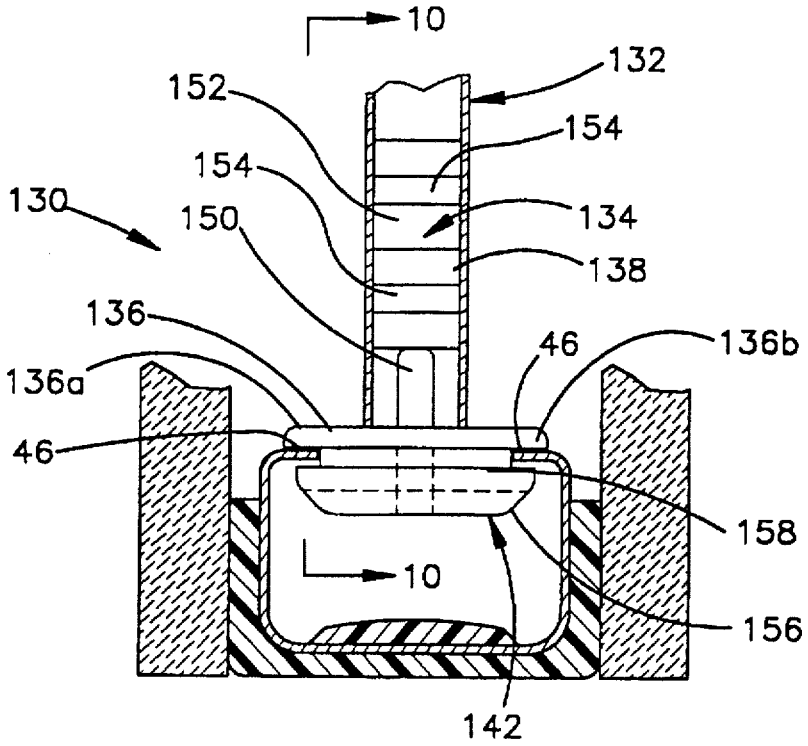
FIG. 9 is an enlarged fragmentary cross sectional view seen approximately from the plane indicated by the line 9—9 of FIG. 1; and, FIG. 10 is a view seen approximately from the plane indicated by the line 10—10 of FIG. 9.
Figure 10:
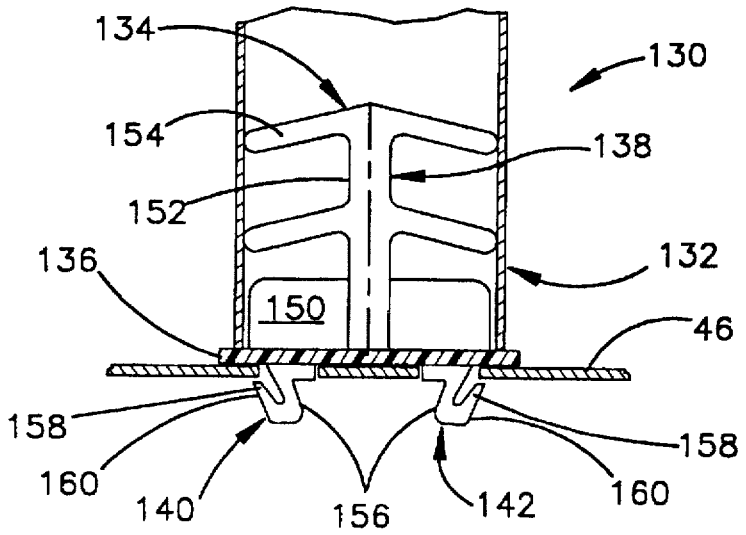

The frame 16 extends about the unit periphery to provide a structurally strong, stable spacer for maintaining the lights aligned and spaced while minimizing heat conduction between the lights via the frame. The preferred frame 16 comprises a plurality of spacer frame elements, or members, **30*a*–d (see FIGS. 5–7) connected to form a planar, polygonal frame shape, with the frame element junctures structures 32*a*–*d*, and connecting structure 34** for joining opposite frame element ends to complete the closed frame shape.

Each frame member 30 is elongated and has a channel shaped cross section defining a peripheral wall 40 and first and second lateral walls 42, 44. See FIG. 2. The peripheral wall 40 extends continuously about the unit 10 except where the connecting structure 34 joins the frame member ends. The lateral walls 42, 44 are integral with respective opposite peripheral wall sides. The lateral walls extend inwardly from the peripheral wall 40 in a direction parallel to the planes of the lights and the frame. The preferred frame 16 has stiffening flanges 46 formed along the inwardly projecting lateral wall edges. The lateral wails 42, 44 rigidify the frame member 30 so it resists flexure and bending in a direction transverse to its longitudinal extent. The flanges 46 stiffen the wails 42, 44 so they resist bending and flexure transverse to their longitudinal extents.

The frame 16 is preferably constructed from a thin ribbon of stainless steel material (e.g. 304 stainless steel having a thickness of 0.006–0.010 inches) which is passed through forming rolls to produce the wails 40, 42, 44. The formed ribbon (see FIGS. 6 and 7) is an elongated linear rigid channel member. In the preferred and illustrated embodiment of the invention the desiccant body 22 is attached to the frame wall 40 and disposed on each of the frame members 30*a–d*. The desiccant body 22 is formed by a desiccated matrix in which a particulate desiccant is incorporated in a vehicle material which is adhered to the frame. The vehicle material may be silicone, hot melt, polyurethane, or other suitable materials. The desiccant absorbs moisture from the surrounding atmosphere for a time after the desiccant is exposed to the atmosphere. Thus the desiccant absorbs moisture from the atmosphere within the space 20 for some time after the unit 10 has been fabricated. This assures that condensation within the unit does not occur. In the preferred unit the desiccant body 22 is extruded onto the frame 16 by an extruder.

The frame corner structures 32 facilitate manual frame bending to the final, polygonal frame configuration in the unit 10 while assuring an effective vapor seal at the frame corners. In the preferred embodiment the frame 16 is initially formed in a single straight length with the sealant body 18 in place on the straight frame. The corner structures 32 initially comprise notches 50 and weakened zones 52 formed in the walls 42, 44 at frame corner locations. See FIGS. 6 and 7. The notches 50 extend into the walls 42, 44 from the respective lateral wall edges. The lateral wall 42, 44 extend continuously along the frame 16 from one end to the other. The walls 42, 44 are weakened at the corner locations because the notches reduce the amount of lateral wall material and eliminate the stiffening flanges 46.

The weak zones 52 at each corner act to restrict frame bending to a crease line 54 extending across the wall 40 at that corner and to form a pleat 56, or sealant pocket, at the corner. In the preferred embodiment the weak zones 52 are formed by a series of five score lines radiating across the lateral walls 42, 44 from the corner crease line location. The weak zones are bowed inwardly from the plane of their associated lateral walls. The sealant body 18 adheres and conforms to the inwardly bowed weak zones. When the frame is bent to its final configuration the weak zones 52 collapse inwardly (with the sealant adhered) in a controlled bending action which forms the pleat 56. Each pleat 56 forms a pocket-like conical, or pyramid shaped, channel 58 filled with sealant having its apex adjacent the corner crease line 54 and its base opening within the frame channel (see FIGS. 2 and 3).

The weak zones 52 are specially formed so that the frame corners are well defined, without use of tools or fixtures, simply by manually bending the frame into its final configuration. The controlled corner formation is assured in the preferred frame by score lines 60*a*, 60*b* extending normal to each other and at 45 ° angles from the plane of the wall 40. When the frame is bent the lines 60*a*, 60*b* define mitre-like creases in the lateral walls which confront each other when the frame corner forms a 90° angle.

The weak zones 52 are unsymmetrically formed about the centerline of the frame wall 40. Thus when the frame corners are bent the weak zones collapse inwardly to form the pleats without clashing. This is particularly important in constructing relatively narrow spacer assemblies (e.g. where the wall 40 is only about ⅜ inch wide). The score lines 60*c–e* are formed to assure this non clashing relationship. The line 60*c* bisects the angle between the lines 60*a*, 60*b* to define the inwardly projecting limit of pleat extension. The lines 60*d*, 60*e* respectively bisect the angle between the lines 60*a*, 60*c* and 60*b*, 60*c*. The score lines 60*d* in the frame wall 42 all weaken the wall more than the score lines 60*e* in the wall 42. The score lines 60*e* in the wall 44 all weaken the wall 44 more than do the score lines 60*d*. The weak zones are deformed, or dished, inwardly before the sealant is applied with the inward deformation being nonsymmetrical due to differential weakening. This differential weakening of the weak zones 52 is illustrated in an exaggerated way in FIG. 6. When the frame is bent to its final configuration the weakened zones collapse inwardly along nonintersecting skew lines so clashing is avoided.

The sealant is applied to the lateral walls 42, 44 at the corner locations before the frame is bent so the sealant adheres to the inwardly dished weak zone walls. Some of this sealant at the frame corners is entrapped within the pleats 56 after the frame is bent. This sealant fills the pleats to assure the conical channel 58 blocks vapor infiltration at the frame corner. Some sealant may well out of the pleats between the adjacent score lines 60 to the external lateral sides of each frame corner as the frame is bent. This is beneficial because adequate corner sealant is assured.

The connecting structure 34 secures the opposite frame ends 62, 64 together when the frame has been bent to its final configuration. The illustrated connecting structure comprises a connecting tongue structure 66 continuous with and projecting from the frame structure end 62 and a tongue receiving structure 70 at the other frame end 64. The preferred tongue and tongue receiving structures 66, 70 are constructed and sized relative to each other to form a telescopic joint 72. When assembled, the telescopic joint 72 maintains the frame in its final polygonal configuration prior to assembly of the unit 10.

In the preferred embodiment the tongue 66 is formed as a frame corner extension and comprises a tongue body 74 and tongue stiffening walls 76, 78. The tongue body 74 is formed an extension of the frame wall 40 and joins the wall 40 at a corner bend line 54*a*. A corner structure 32*a* is formed at the junctures of the tongue walls 76, 78 and the respective lateral walls 42, 44. When the sealant body 18 is applied to the frame structure it terminates at the corner structure 32*a* so that the tongue body and walls are free from any sealant material. The same is true of the desiccant body 22, which does not extend to the tongue 66.

After the sealant body has been applied to the frame 16 the frame is bent at the corners 32 into its final planar rectangular shape. The tongue 66 is bent about the corner bend line 54*a* for telescoping engagement with the tongue receiving frame end 64. The corner structure 32*a* defines tongue pleats 80 (similar to the pleats 56) respectively joining the frame walls 42, 44 with the respective tongue walls 76, 78. The preferred tongue body 74 is narrower than the wall 40 so that it can be inserted within the tongue receiving frame member end 64 to complete the telescopic joint 72. The tongue 66 is abruptly narrowed at the location where the tongue pleats 80 join the respective sidewalls 42, 44. The junctures of the tongue pleats and frame sidewalls each form a mitre-like angled step, or shoulder, 84.

The tongue body 74 is just enough narrower than the frame wall 40 that the tongue walls 76, 78 frictionally engage the respective receiving frame member walls 42, 44. Maintenance of the frictional fit between the tongue walls 76, 78 and the lateral frame walls 42, 44 is assured by a resiliently deflectable crown 81 extending along the longitudinal centerline of the tongue body 74. The crown is deflected somewhat as the tongue is inserted into the frame end 64 to provide a resilient spring-like effect urging the walls 76, 78 into engagement with the frame walls 42, 44.

In the preferred embodiment the tongue body 74 and tongue walls 76, 78 are subjected to a swedging operation after the frame members are substantially fully formed. The swedging operation narrows the tongue body by forcing some of the tongue body material into the tongue walls, thus reducing the tongue width. The swedging operation may also produce the crown 81.

The frame end 64 is formed so the walls 42, 44 terminate in a mitre cut edge 82 which, when the telescopic joint 72 is properly formed, confronts and extends immediately adjacent the shoulder 84. The shoulder 84 forms a stop for the edge 82 when the joint is fully assembled. The edge 82 is aligned with the shoulder 84 so that the exterior laterally facing frame surfaces at the corner structure 32*a* are in common planes.

The frame end 64 is constructed to provide a keeper structure for engaging the tongue wall edges 92, 94 when the telescopic joint is completed. The preferred keeper structure is formed by the lateral wall flanges 46 which serve to maintain the tongue 66 within the frame end 64, but other keeper structures, such as corrugations formed in the lateral frame walls 42, 44, could be employed if desired.

In the illustrated embodiment the connector structure 34 further comprises a fastener arrangement 100 for both connecting the opposite frame ends together and providing a temporary vent for the space 20 while the unit 10 is being fabricated. The illustrated fastener arrangement (see FIGS. 1, 4, 5 and 6) is formed by conforming holes 102, 104 located, respectively, in the tongue 66 and the frame end 64 and a rivet 106 extending through the holes 102, 104 for clinching the tongue 66 and frame end 64 together.

The holes 102, 104 readily communicate the air space 20 in the unit 10 to the ambient atmosphere when the unit 10 is first assembled before the rivet 106 is installed. The holes are aligned when the tongue and tongue receiving structure are telescoped together. The sealant body 18 at the location of the frame hole 104 defines an opening surrounding the hole. Likewise the desiccant body 22 does not obstruct the hole 104 because the desiccant body 22 is not applied to the frame end 64in the vicinity of the hole 104. As noted above, the tongue hole 102 is also clear of sealant and the desiccant body because they are not applied to the tongue 66.

Accordingly when the unit 10 is heated and pressed to bond the lights 14 and spacer assembly 12 together, the holes 102, 104 communicate the space 20 to the surroundings and the space 20 remains at atmospheric pressure. This is to be distinguished from units which, after they are assembled and cooled down, exhibit inward light diaphragming which must be relieved by piercing the unit sealant.

The rivet 106 is installed after the unit 10 has been heated, pressed and cooled to about room temperature. In a preferred embodiment of the invention the space 20 is flooded with an inert gas (such as Argon) just before the rivet is placed. The rivet 106 is a "blind" rivet carrying a resilient sealing ring 110 about its central hollow shaft 112. When the rivet is set, its interior end 114 is upset and mushroomed into firm engagement with the tongue body 74. The rivet head 116 forces the sealing ring 110 into tightly compressed sealing engagement with the frame wall 40 surrounding the hole 104. No further communication through the holes is possible so the inert gas is trapped in the space 20.

After the rivet 106 is set, additional sealant is gunned or trowelled (or otherwise applied) onto the unit 10 to cover the rivet and the corner structure 32*a* where the opposite ends of the sealant body 18 meet. The material at the juncture of the sealant body ends is smoothed over to assure an effective vapor barrier at the corner 32*a*.

In some circumstances it may be desirable to provide two vents in the unit 10 so the inert gas flooding the space 20 can flow into the space 20 through one vent displacing residual air from the space through the second vent. The drawings shows such a unit. See FIGS. 1, 5 and 6. The second vent 120 is formed by a punched hole in the frame wall 40 spaced along the common frame member from the hole 104. The sealant body 18 and the desiccant body 22 each define an opening surrounding the vent 120 so that air venting from the space 20 is not impeded. The second vent 120 is closed by a blind rivet 122 identical to the rivet 106. The rivets 106, 122 are installed at the same time and each is covered with sealant material so that the seal provided by each rivet is augmented by the sealant material.

The unit 10 is illustrated as constructed to simulate the appearance of a multipane window. This is accomplished by the inclusion of a muntin bar simulating assembly 130 in the unit (FIG. 1). The muntin bar simulating assembly 130 is referred to here as a muntin bar assembly for simplicity, but it is not a true muntin bar assembly because the individual muntin bars do not connect with panes or lights in the windows.

The muntin bar assembly 130 comprises bar members 132 extending across the space 20 between the lights 14, and clips 134 for connecting the bars 132 to the spacer assembly 12. The bars 132 are formed by elongated metal tubes having generally rectangular cross sectional shapes. Each illustrated bar 132 extends between the mid-points of its associated frame members through the center of the space 20. The bars 132 are provided with dados at their intersection.

The clips 134 detachably secure the bars to the spacer frame 16. Each clip comprises a body 136, a bar support 138 projecting in one direction from the body, and latches 140, 142 projecting in the opposite direction from the body. The preferred clip 134 latches into small rectangular notches 144 (FIG. 6) formed in the associated frame wall stiffening flanges 46 with the clip body extending adjacent the flanges 46. The notches 144 are relatively shallow and do not extend the full depth of the stiffening flanges 46. Accordingly the frame members are not materially weakened at the notch locations since the flanges 46 remain substantially intact and effective to strengthen the frame member.

The body 136 is a flat rectangular or square plate-like member having opposite margins 136*a*, 136*b* seated on the frame wall stiffening flanges 46. The latches 140, 142 project from the body between the flanges 46 into the channel formed by the frame member while the bar support 138 projects into the space 20.

The bar support 138 comprises a base flange 150 integral with the body 136, a central spine 152 projecting from the base flange, and bar retaining fingers 154 which fit into the muntin bar interior. When the bar support 138 is inserted into a bar 132 the open end of the muntin bar 132 extends about the base flange 150 and the fingers frictionally engage the muntin bar interior to secure it to the dip 134.

Each latch 140, 142 comprises a relatively rigid latch body member 156 projecting from the clip body and a thin latching finger 158 extending from the projecting end of the latch body back toward the adjacent clip body margin. Each latching finger is resiliently deflectable toward and away from the latch body. The latching body and finger are formed with a wedge face 160 on one side which facilitates inserting the clip into the receiving flange notch 144. The finger 158 is resiliently deflected by the flange notch edge as the clip is inserted into the frame member. When the finger 158 clears the notch edge the finger snaps back to its undeflected position and traps the flange 46 between the finger 158 and the clip body 136.

While a preferred embodiment of the invention has been illustrated and described in detail, the present invention is not to be considered limited to the precise construction disclosed. For example, an insulating glass unit constructed according to the present invention might employ a sealant body formed from multiple hot melt seals, multiple polyisobutylene seals, or from a single polyurethane or polysulfide seal. Such sealant bodies might be supplemented with still a further layer of sealant material extending about their peripheries. Various adaptations, modifications and uses of the invention may occur to those skilled in the art to which the invention relates and the intention is to cover hereby all such adaptations, modifications and uses which fall within the spirit or scope of the appended claims.

Having described my invention I claim:

1. A clip for securing a muntin bar to a planar spacer frame of an insulating glass unit comprising:

a. bar support for engaging a muntin bar, said bar support projecting from said clip in a first direction and having opposed sides respectively bounded by first and second planes extending in said first direction, said clip being adapted to be installed such that said first and second planes extend parallel to a plane defined by said planar spacer frame; and, b. latch structure for securing the clip to the spacer frame;

c. said latch structure comprising a plurality of fingers constructed for latching engagement with the spacer frame;

d. said latch structure defining at least two pairs of latching locations engagable with the spacer frame, the latching locations of each pair spaced apart transversely relative to said first and second planes with said first and second planes disposed therebetween and each latching location spaced away from the closest one of said planes.

2. The clip claimed in claim 1 wherein said clip further comprises clip body structure comprising a surface portion adjacent a projecting end of each latch finger, space between each said surface portion and a respective finger being occupied by a spacer frame wall when said latch structure engages said the spacer frame at said locations.

3. The clip claimed in claim 1 further comprising clip body structure connecting the bar support and latch structure, said latch structure comprising a plurality of relatively rigid latch body members projecting from said clip body structure to said latch fingers, said latch fingers extending from the projecting portions of said latch body members back toward said clip body.

4. The clip claimed in claim 3 wherein said clip body structure comprises a plate-like member having opposite ends adapted to be spaced axially apart in the direction of the spacer frame plane when the clip engages the spacer frame and opposite sides adapted to be spaced apart transversely of the spacer frame plane when the clip engages the spacer frame.

5. The clip claimed in claim 4 wherein two spaced apart latch body members extend across said plate-like member between said opposite side, each latch body member defining opposite ends with a respective one of said location adjacent each end of each latch body member.

6. The clip claimed in claim 5 wherein said clip body plate-like member defines surface portions adjacent each projecting ends of each latch finger, space between each said surface portion and a respective latch finger adapted to be occupied by a spacer frame wall when said latch structure engages the spacer frame at said locations, said surface portions and said fingers adapted to coact to prevent dislodgement of the clip from the spacer frame wall, said latch body members each defining a face aligned with said space between said surface portion and each latch finer, said faces adapted to engage the spacer frame wall and limit clip motion axially along the spacer frame.

7. A clip for securing a muntin bar to a frame member of a planar insulating glass unit spacer frame comprising: a bar support for engaging a muntin bar, said bar support being adapted to project from the frame member toward an interior of the unit spacer frame when the clip is secured to the frame member, said bar support comprising opposed sides bounded by respective first and second planes such that upon installation said first and second plane extend parallel to a planes defined by said frame member and opposed ends extending transverse to said sides, said bar support and muntin bar telescopically related when engaged; and, latch structure for securing the clip to the spacer frame comprising first and second latch body members projecting oppositely from said bar support, each said latch body member extending transversely relative to said first and second planes and defining first and second opposite ends spaced apart in a direction transversely relative to the first and second planes, with said first and second planes disposed between said first and second opposite ends, each latch body member defining a securing location adjacent each end thereof with said securing locations each spaced away from the respective closest one of said first and second planes, said latch structure further comprising at least a resiliently flexible latch finger connected to each latch body member adjacent an end thereof, said first ends of said first and second latch body members being adapted to be spaced apart axially along the frame member when said clip is secured to said frame member and said second ends of said first and second latch body members being adapted to be spaced apart axially along the frame member when said clip is secured to said frame member.

8. The clip claimed in claim 7 further comprising clip portions defining surfaces adapted to engage the spacer frame when the clip and spacer frame are secured together, said surfaces spaced from said latch fingers in said first direction and extending beyond said latch body member ends in said second direction.

9. The clip claimed in claim 8 wherein each clip portion surface is juxtaposed with and spaced slightly away from a respective latch finger with the space between each surface and juxtaposed latch finger adapted to exceed a the thickness of the spacer frame wall.

10. A clip for securing a muntin bar to a spacer frame member of an insulating glass unit, the clip comprising:

muntin bar engaging structure projecting in a first direction away from the clip, the muntin bar engaging structure adapted to secure the clip and muntin bar together said muntin bar engaging structure defining opposed sides respectively, bounded by first and second planes extending in said first direction, said clip being adapted to be installed such that said first and second planes extend parallel to a plane defined by said insulating glass unit; and, latching structure projecting oppositely from the muntin bar engaging structure in said first direction and adapted to secure the clip and spacer frame together, the latching structure comprising first and second relatively rigid elongated latch body members each extending in a direction transverse to the first direction and each defining first and second opposite ends spaced apart in said transverse direction with said first and second planes disposed between said opposite ends, at least a resiliently flexible latch finger connected to each latch body member adjacent an end thereof, said latch fingers each defining a resiliently deflectable spacer frame member engaging portion spaced away from the nearest of said first and second planes in said direction transverse to said first direction and adapted to resiliently engage a spacer frame member and deflect as the clip is being inserted in the spacer frame member and thereafter to spring back to an undeflected position to enable latching the clip and spacer frame member together.

* * * * *